US010066591B2

(12) United States Patent
Capozzella et al.

(10) Patent No.: US 10,066,591 B2
(45) Date of Patent: Sep. 4, 2018

(54) PROCESS FOR STARTING AN INTERNAL COMBUSTION ENGINE

(71) Applicant: Piaggio & C. S.p.A., Pontedera (PI) (IT)

(72) Inventors: Paolo Capozzella, Pontedera (IT); Jury Cantini, Pontedera (IT); Jeanpaul Milani, Pontedera (IT)

(73) Assignee: PIAGGIO & C. S.P.A., Pontedera (PI) (IT)

( * ) Notice: Subject to any disclaimer, the term of this patent is extended or adjusted under 35 U.S.C. 154(b) by 0 days.

(21) Appl. No.: 15/320,875

(22) PCT Filed: Jul. 30, 2015

(86) PCT No.: PCT/IB2015/055765
§ 371 (c)(1),
(2) Date: Dec. 21, 2016

(87) PCT Pub. No.: WO2016/016835
PCT Pub. Date: Feb. 4, 2016

(65) Prior Publication Data

US 2017/0198675 A1 Jul. 13, 2017

(30) Foreign Application Priority Data

Aug. 1, 2014 (IT) ..... RM2014A0446

(51) Int. Cl.
*F02N 11/10* (2006.01)
*F02N 11/14* (2006.01)
(Continued)

(52) U.S. Cl.
CPC ..... *F02N 19/005* (2013.01); *F02N 11/087* (2013.01); *F02N 11/0862* (2013.01);
(Continued)

(58) Field of Classification Search
CPC .. F02N 11/108; F02N 11/0862; F02N 11/087; F02N 11/04; F02N 11/0822;
(Continued)

(56) References Cited

U.S. PATENT DOCUMENTS 5,458,098 A 10/1995 Yagi
5,713,320 A 2/1998 Pfaff et al.
(Continued)

FOREIGN PATENT DOCUMENTS

EP 1046813 A1 10/2000
EP 1055816 A1 11/2000
(Continued)

*Primary Examiner* — Mahmoud Gimie
(74) *Attorney, Agent, or Firm* — Volpe and Koenig, P.C.

(57) ABSTRACT

A process for starting an internal combustion engine, providing the use of an electric motor acting on the driveshaft of the internal combustion engine, provides a positioning step, activated upon switching-off the engine, and a switching-on step, activated after a starting control, wherein said positioning step comprises: a forward rotation by a predetermined forward rotation angle; a detection of a possible stall state followed, in negative case, by an additional forward rotation until reaching a predetermined maximum forward rotation angle; an inverse rotation by a predetermined angle; and a detection of a possible stall state followed, in negative case, by an additional inverse rotation until reaching a predetermined maximum inverse rotation angle.

10 Claims, 2 Drawing Sheets

(51) Int. Cl.
*F02N 19/00* (2010.01)
*F02N 11/04* (2006.01)
*F02N 11/08* (2006.01)

(52) U.S. Cl.
CPC ..... *F02N 11/108* (2013.01); *F02N 11/04* (2013.01); *F02N 11/0822* (2013.01); *F02N 2200/041* (2013.01); *F02N 2200/044* (2013.01); *F02N 2200/14* (2013.01); *F02N 2250/04* (2013.01); *F02N 2250/06* (2013.01)

(58) Field of Classification Search
CPC ..... F02N 19/005; F02N 2200/041; F02N 2200/044; F02N 2200/14; F02N 2250/04; F02N 2250/06
USPC ..... 123/179.3
See application file for complete search history.

(56) References Cited

U.S. PATENT DOCUMENTS

| | | | | |
|---|---|---|---|---|
| 6,877,470 | B2 | 4/2005 | Mitani et al. | |
| 2004/0000281 | A1* | 1/2004 | Wakitani | F02N 11/0848 123/179.3 |

FOREIGN PATENT DOCUMENTS

| | | | | |
|---|---|---|---|---|
| EP | 1233175 | A1 | 8/2002 | |
| EP | 1321666 | A1 | 6/2003 | |
| EP | 1365145 | A2 | 11/2003 | |
| EP | 1375907 | A2 | 1/2004 | |
| EP | 3173605 | A1 * | 5/2017 | F02D 29/02 |

* cited by examiner

PROCESS FOR STARTING AN INTERNAL COMBUSTION ENGINE

The present invention relates to a process for starting an internal combustion engine, providing the use of an electric motor acting on the driveshaft of the internal combustion engine.

BACKGROUND

This process is particularly advantageous to perform the procedure of starting engines wherein the engine automatic switching-off is provided when the vehicle is still, and preferably it suits to single-cylinder motors for motor vehicles such as scooters and the like, wherein the electric motor, which obviously even acts as generator, is fitted directly on the driveshaft.

In this configuration, one tries to optimize the sizes and the torque which the electric motor has to exert to be able to carry out the functions thereof.

To this purpose, when the motor has to be re-started, that is when the motor switches off as the vehicle has stopped, a re-starting procedure is used providing the rotation of the electric motor to arrange the piston, inside the cylinder, in the position requesting the lowest possible torque for re-starting, by considering that the latter has to take place during a very short instant, by absolutely avoiding the stall of the piston inside the cylinder.

The U.S. Pat. No. 5,458,098 A describes a procedure of this type, devised for multi-cylinder motors of automobile type.

Generally, the electric motor in this phase is rotated with a limited torque therefore the piston cannot exceed the upper dead centre corresponding to the compression phase, by rotating the driveshaft both forwards and backwards.

In the above-mentioned document, upon each stop a backward rotation is performed, said inverse rotation to move away the pistons from the closest compression phase: from this point on the electric motor is rotated forwards for the starting, the kinetic energy which is accumulated during the forward rotation allows exceeding the closest compression phase by re-starting the engine, even if the torque would not have been sufficient to exceed it by starting from a much more approached phase.

The inverse rotation is performed by a pre-established rotation angle ($\pi/4$ in case of an engine with four cylinders wherein there is a compression phase every $\pi/2$ of rotation) or for a pre-established rotation time, provided that the piston does not prevent the inverse rotation before.

However, in a single-cylinder engine, the adjacent compression phases are spaced apart therebetween, in terms of rotation angle by an angle of $2\pi$, and therefore, it is difficult to establish a fixed angle and/or inverse rotation time to be sure to perform the re-starting.

Even in the U.S. Pat. No. 5,713,320 A a procedure similar to the previous one is described, wherein the electric motor is rotated inversely with low power, until reaching the closest compression phase.

The European patent Nr. 1,046,813 describes an inverse rotation procedure, wherein the intervention of a sensor is provided, detecting the friction during it, to understand when the inverse rotation can cease.

However, it is to be noted that this kind of sensor has to be forcedly an additional component of the switching-on system, and an extra resource to be managed.

On the contrary, the European patent Nr. 1,233,175 describes a procedure using a sensor able to detect the absolute angular position of the driveshaft, therefor the comment of the previous document is valid.

Analogously, the European patent Nr. 1,321,666 still describes a procedure wherein the inverse rotation angle applied to the crankshaft is detected.

The procedure of the European patent application Nr. 1,365,145 is analogous to those described in the mentioned documents.

In the procedure of the European patent Nr. 1,375,907, in order to understand when the inverse rotation has to be interrupted, the speed of the crankshaft, instead of the position thereof, is detected, thus by requesting the presence of an additional sensor.

On the contrary, the U.S. Pat. No. 6,877,470 describes a procedure wherein the inverse rotation is preceded by a forward rotation until the compression phase, indeed to be able to use a finished quantity of inverse rotation. However, this procedure is devised for the automobile field wherein small rotations and high torques are involved.

The European patent application Nr. 1,055,816 A1 describes a procedure wherein the positioning has to be made by knowing the engine angular position with high precision, in order to be able to perform a re-starting.

The technical problem underlying the present invention consists in providing a switching-on process allowing to obviate the drawbacks mentioned with reference to the known art.

SUMMARY

Such problem is solved by a starting process as specified above, providing a positioning step, activated upon switching-off the engine, and a switching-on step, activated after a starting control, said positioning step comprising:

a forward rotation by a predetermined forward rotation angle;

a detection of a possible stall state followed, in negative case, by an additional forward rotation until reaching a predetermined maximum forward rotation angle;

an inverse rotation by a predetermined inverse rotation angle; and a detection of a possible stall state followed, in negative case, by an additional inverse rotation until reaching a predetermined maximum inverse rotation angle.

The main advantage of the starting process according to the present invention consists in allowing a guaranteed starting even by using an optimized electric motor in terms of maximum torque and sizes.

In fact, both the inverse rotation starting position and the end position are determined by the subsequent meeting of at least one of the two following conditions: one relating the possible reached stall and the other one the performance of a maximum rotation angle.

As it will be clear hereinafter, in order to determine these conditions it is not necessary using an additional sensor by the unit monitoring the electric motor.

BRIEF DESCRIPTION OF THE DRAWINGS

The present invention will be described hereinafter according to a preferred embodiment example thereof, provided by way of example and not for limitative purposes with reference to the enclosed drawings wherein.

DETAILED DESCRIPTION OF THE PREFERRED EMBODIMENTS

Figure 1:
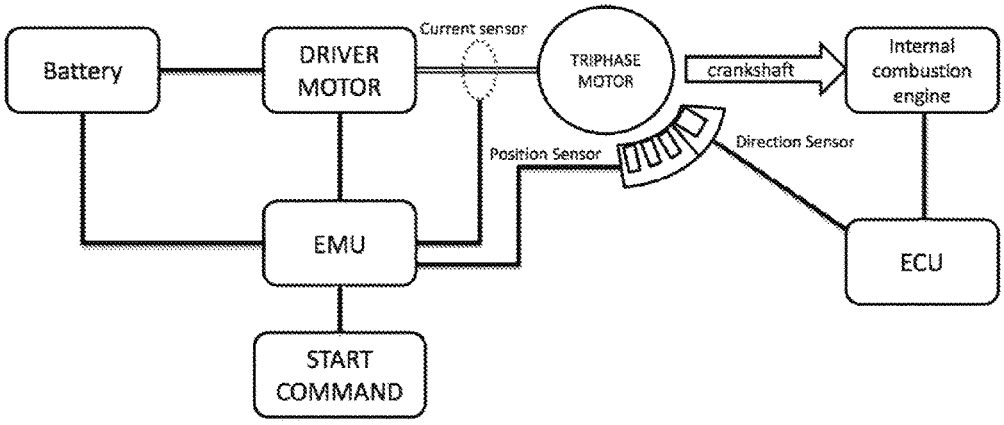
FIG. 1 shows a diagram of a switching-on system performing the starting process according to the present invention.

By referring to FIG. 1, a switching-on system is represented apt to perform the starting process according to the present embodiment example.

It comprises a three-phase electric motor, of the brushless type with permanent magnets (THREE-PHASE MACHINE) which is driven by an actuating device (MOTOR DRIVER) which in turn receives electric current from a battery.

Both the actuating device and the battery are managed by a unit monitoring the electric motor (EMU) pre-arranged for receiving a command for switching on the engine from a suitable input (START COMMAND). In the specific case, this input can receive a signal generated by a button, by rotating a key, by opening the throttle valve of the system for supplying fuel coming from an accelerator, by shifting or by detecting a starting signal exerted by the driver on the command, pedal or knob, of the accelerator and so on.

The last two types of starting signal are those used in case of an engine and a switching-on system pre-arranged for switching-off the engine upon each stop of the vehicle, or upon each stop beyond a certain duration, to switch it on again automatically when the driver shows the intention of continuing running as if the engine had not been previously switched off.

The engine-monitoring unit (EMU) receives a piece of information relating the current supply to the electric motor from one or more specific sensors (Current sensor); it further receives pulses which represent the relative position of the rotor of the electric motor with respect to the stator.

In the present embodiment example such pulses are phase pulses generated by phase sensors of the stator of the electric motor (Position sensor), that is the three sensors with Hall effect therewith the stator is equipped.

The electric motor is mechanically connected to the internal combustion engine directly by means of the crankshaft coinciding with the shaft of the electric motor.

Furthermore, the stator of the electric motor is even equipped with a particular sensor providing a signal representing the rotation direction of the rotor with respect to the stator.

Such signal, for example generated by a sensor comprising two sub-sensors with Hall effect, is not connected to the unit monitoring the electric motor, but to a unit for monitoring the internal combustion engine (ECU) regulating the electric supply of the internal combustion engine, that is the sparking plugs, and the supply of the combustible mixture.

By referring to the present embodiment example, such switching-on system is pre-arranged for a four-stroke monocylinder motor of substantially motorcycle type.

Figure 2:
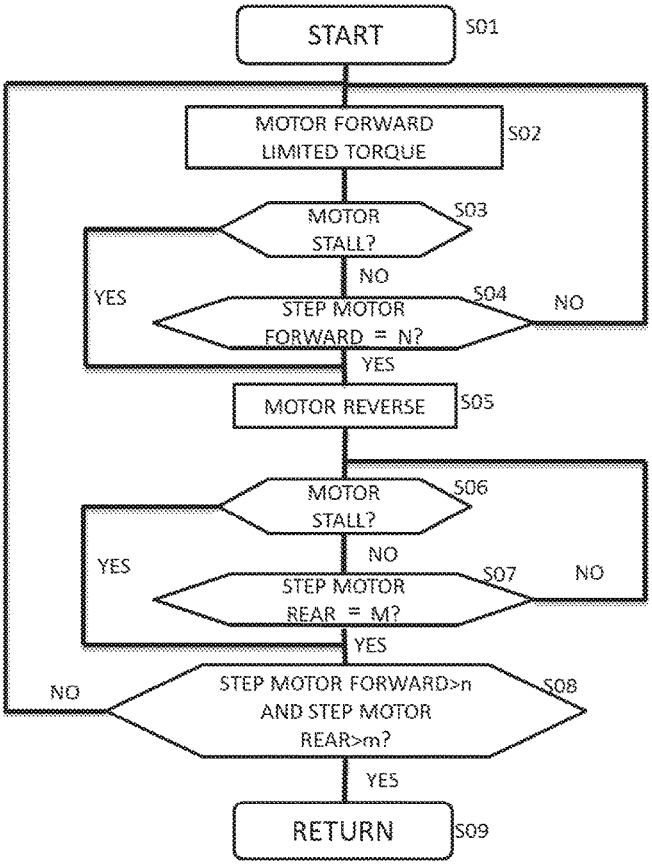
FIG. 2 shows a block diagram illustrating the positioning strategy in the starting process according to the present invention.

By referring to FIG. 2, on the contrary, a first positioning step is detailed which takes place after switching off the motor, that is when the vehicle stops.

Such positioning step comprises a first forward rotation of the electric motor by a first predetermined forward rotation angle. This rotation approaches the piston of the internal combustion engine to the subsequent compression phase therefrom, ideally, it can be far by a rotation angle comprised between 0° and 720°.

The first predetermined angle of said first forward rotation could be comprised between 350° and 700°, preferably 550°.

If during this rotation the electric motor reaches a stall position, that is if the piston reaches the compression phase, the unit monitoring the electric motor (EMU) detects the stall by means of the current intensity sensor or by means of counting the phase pulses which would interrupt prematurely, and at this point the electric motor is ready to be controlled in inverse rotation.

In negative case, if the possible stall state is not detected, the electric motor is controlled by the monitoring unit thereof (EMU) in an additional forward rotation until reaching a predetermined maximum forward rotation angle.

Such maximum forward rotation is determined by a number N of phase pulses detected by said phase sensors. The choice of the number N of pulses is made to guarantee a rotation angle so as to meet certainly the forward compression phase.

Preferably N is comprised between 35 and 70, for example equal to 55.

In order to fulfil this second condition, the positioning step comprises an inverse rotation which takes place with analogous modes to those described for the forward rotation.

First of all a first inverse rotation by a first predetermined inverse rotation angle is performed, preferably comprised between 350° and 700°, for example 550°; if a stall state is reached, detected by the unit for monitoring the electric motor (EMU) as previously described, then the electric motor is ready for a subsequent switching-on phase.

In the negative case, that is if the stall is not detected, the electric motor is controlled by the monitoring unit thereof (EMU) in an additional inverse rotation until reaching a predetermined maximum inverse rotation angle.

Again, such maximum inverse rotation angle corresponds to a number M of phase pulses detected by said phase sensors, so as to guarantee the stall. Preferably M is comprised between 35 and 70, for example 55.

Figure 3:
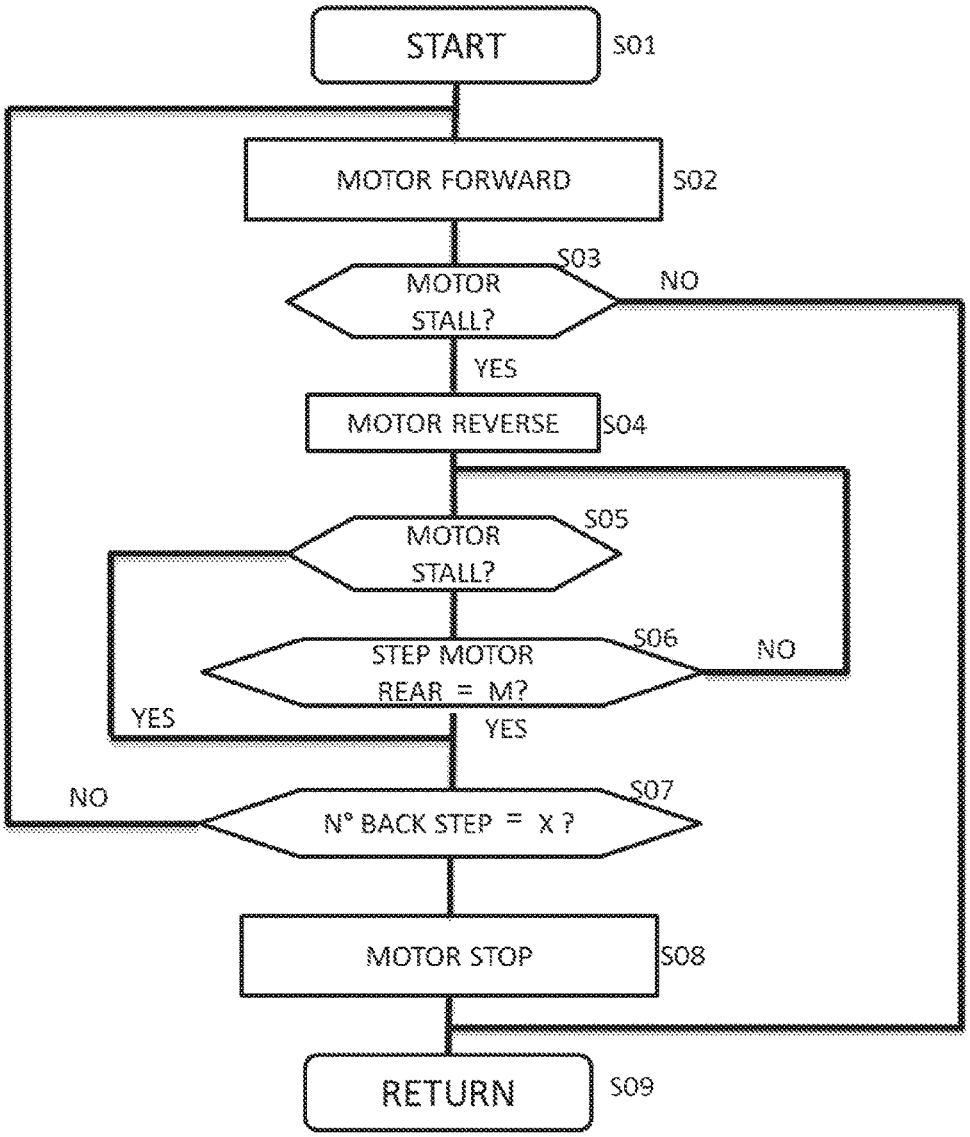
FIG. 3 shows a block diagram illustrating a switching-on strategy in the re-starting process according to the present invention.

In order to satisfy this second condition, the positioning step has ended and the switching-on system is ready to perform the subsequent switching-on phase (FIG. 3).

Even the switching-on phase follows modes similar to the ones described previously.

First of all, the electric motor is forward controlled, by actuating it at the maximum torque, condition which in the previous rotations was not strictly necessary.

If the positioning performed previously is correct and if all other surrounding conditions allow it, the engine switches on by overcoming the subsequent compression phase.

It is to be noted that in this phase, the unit monitoring the internal combustion engine (ECU), based upon the signal received by the direction sensor, authorizes the switching-on of the sparking plugs and the mixture supply, without this piece of information is managed by the unit monitoring the electric motor.

If the engine did not switch-on, then one would be in a state of additional stall. In this case, the positioning procedure is repeated by means of the only inverse rotation described previously for the positioning step.

It is to be noted that, during this inverse rotation, the switching-on of the sparking plug and the mixture supply is however inhibited, even upon the possible reaching of a compression phase, directly by the unit monitoring the internal combustion engine (ECU), by means of the signal received by said direction sensor.

At the end of the inverse rotation, which can even be performed for a second predetermined inverse rotation angle, the switching-on phase is performed again, and so on, until the switching-on or until performing a predetermined number X of attempts, at the end thereof the system will signal a failure situation.

To the above-described process for starting an internal combustion engine a person skilled in the art, in order to satisfy additional and contingent needs, can introduce several additional modifications and variants, all however within the protective scope of the present invention, as defined by the attached claims.

The invention claimed is:

1. A process for starting an internal combustion engine, providing the use of an electric motor acting on a driveshaft of the internal combustion engine, providing a positioning step, activated upon switching-off the engine, and a switching-on step, activated after a starting control, wherein said positioning step comprises:

a forward rotation by a predetermined forward rotation angle;

a detection of a possible stall state followed, in negative case, by an additional forward rotation until reaching a predetermined maximum forward rotation angle;

an inverse rotation by a predetermined angle; and a detection of a possible stall state followed, in negative case, by an additional inverse rotation until reaching a predetermined maximum inverse rotation angle.

2. The process according to claim 1, wherein said stall state is detected by an engine-monitoring unit (EMU), which receives information about a current supply to the electric motor, from an electric sensor (Current sensor).

3. The process according to claim 1, wherein said stall state is detected by an engine-monitoring unit (EMU), which receives information about a number of phase pulses detected by phase sensors of a stator of the electric motor.

4. The process according to claim 1, wherein the electric motor comprises a rotor and a stator, the stator of the electric motor is equipped with a sensor providing a signal representing a rotation direction of the rotor with respect to the stator which is sent to a unit for monitoring the internal combustion engine (ECU) regulating an electric supply of the internal combustion engine, and a supply of a combustible mixture.

5. The process according to claim 1, wherein said predetermined forward rotation angle of said first forward rotation is comprised between 350° and 700°.

6. The process according to claim 3, wherein said maximum forward rotation angle is determined by a number N of phase pulses detected by said phase sensors.

7. The process according to claim 1, wherein said predetermined inverse rotation angle of said first forward rotation is comprised between 350° and 700°.

8. The process according to claim 3, wherein said maximum inverse rotation angle is determined by a number M of phase pulses detected by said phase sensors.

9. The process according to claim 1, comprising a switching-on step providing a forward rotation to determine the starting of the internal combustion engine.

10. The process according to claim 9, wherein, if the starting is not implemented, the positioning procedure is repeated by means of the only one inverse rotation described previously for the positioning step until the switching-on or until performing a predetermined number X of attempts, at the end thereof the system will signal a failure situation.

* * * * *